United States Patent [19]

Hofbauer

[11] 4,259,930

[45] Apr. 7, 1981

[54] DEVICE FOR STARTING A STATIONARY UNIT

[75] Inventor: Peter Hofbauer, Wolfsburg, Fed. Rep. of Germany

[73] Assignee: Volkswagenwerk Aktiengesellschaft, Wolfsburg, Fed. Rep. of Germany

[21] Appl. No.: 60,875

[22] Filed: Jul. 26, 1979

[30] Foreign Application Priority Data

Nov. 22, 1978 [DE] Fed. Rep. of Germany ..... 2850553

[51] Int. Cl.[3] ..... F02N 17/00

[52] U.S. Cl. ..... 123/179 J; 123/179 R; 74/7 C; 192/0.033

[58] Field of Search ..... 123/179 J, 179 K, 179 CC, 123/179 M, 185 F; 74/7 C, 7 R, 6; 192/85 R, 103 R, 0.076; 290/38 R, 38 A

[56] References Cited

U.S. PATENT DOCUMENTS

| | | | |
|---|---|---|---|
| 1,215,783 | 2/1917 | Ellett | 123/185 F |
| 1,248,870 | 12/1917 | Kane | 123/179 J |
| 1,259,876 | 3/1918 | Kratz | 123/179 J |
| 1,275,941 | 8/1918 | Kazenmaier et al. | 123/179 J |
| 3,215,234 | 11/1965 | Hirano | 192/103 R |
| 3,882,950 | 5/1975 | Strohlein | 123/179 J |

*Primary Examiner*—P. S. Lall

*Attorney, Agent, or Firm*—Brumbaugh, Graves, Donohue & Raymond

[57] ABSTRACT

A device for starting a stationary unit, which unit includes a prime mover, e.g. an internal combustion engine, and a machine, e.g. a compressor of a heat pump system, rigidly coupled thereto by a shaft, has a flywheel fitted on the shaft. This flywheel is automatically engaged and disengaged from the shaft, according to the speed of the flywheel, by means of a clutch.

4 Claims, 1 Drawing Figure

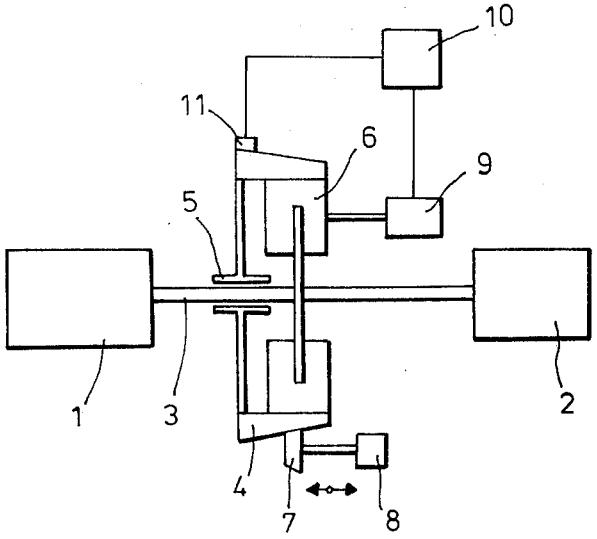
10
11
6
9
5
1
3
2
4
7
8

DEVICE FOR STARTING A STATIONARY UNIT

BACKGROUND OF THE INVENTION

The invention relates to a method and a device for starting a stationary unit including a prime mover, e.g. an internal combustion engine, and a machine rigidly coupled thereto, e.g. a compressor of a heat pump system.

In starting such stationary units wherein the prime mover and the machine to be driven by it are rigidly coupled together, generally a comparatively elaborate and powerful starter is required. Such a starter is commonly powered by an available electric supply network upon which the starting operation places a heavy load.

SUMMARY OF THE INVENTION

The invention relates to a method and a device for starting a stationary unit that includes in particular a prime mover, e.g. an internal combustion engine, and a machine rigidly coupled thereto, e.g. a compressor of a heat pump system.

To simplify the starting of the stationary units wherein the prime mover and the machine to be driven by it are rigidly coupled together, the common shaft of the engine and machine is fitted with a flywheel, capable of being engaged and disengaged by means of a clutch, and driven by a starter. To start the stationary unit, first the flywheel is disengaged from the shaft by means of the clutch and then it is driven by the starter. The flywheel is brought up to a sufficient speed and the clutch is engaged to start the engine which is rigidly coupled to the machine.

In a refinement of this proposed device, the present invention provides that the clutch shall be actuated automatically depending on the flywheel speed. In other words, the clutch is not be to be engaged and disengaged, say, manually by an operator, but automatically as a preassigned flywheel speed is reached. Appropriately, the clutch is engaged at a higher flywheel speed than the speed at which the clutch may be disengaged. This ensures firstly that the clutch will not engage until the flywheel has attained a sufficiently high speed, i.e. a speed sufficient to start and maintain operation of the engine coupled to the machine. Secondly, the disengagement of the clutch is to take place at a comparatively lower speed in order to ensure that the stationary unit powered by the engine may be operated even at very low speeds, which may sometimes be lower than the starting speed. Lastly, however, the flywheel is not to remain connected to the common shaft as the rotational speed decreases down to zero in order to avoid certain critical states of engine operation at extremely low speeds.

For example, conceivably the clutch arranged between the flywheel and the engine-machine shaft of a heat pump compressor driven by a reciprocating piston engine could be so designed that the clutch would engage at a speed of about 1000 rpm when starting and disengage at a lower speed limit of 600 rpm. Disengagement of the clutch would deprive the piston engine of the flywheel required to even out its drive torque, so the engine would stop of its own accord. This is always true if the engine has a torque diagram such that independent operation cannot be sustained without an inertial mass, as is necessarily the case of all four-stroke engines up to four cylinders, for example. Engines with a large number of cylinders may require a special signal, for example to shut off the fuel supply or the ignition, in order to bring them to a stop.

The clutch actuation may be controlled by means of a special system for acquisition and processing of the flywheel speed data. Alternatively, however, a clutch may be provided that will automatically execute the operations of engagement and disengagement according to the rotational speed.

BRIEF DESCRIPTION OF THE DRAWING

The foregoing and other features of the present invention will be more readily understood by reference to the following detailed description and the accompanying drawing of a block diagram of the device according to the invention.

DESCRIPTION OF AN EXEMPLARY EMBODIMENT

In the drawing a prime mover 1, in the form of a conventional internal combustion engine, drives a compressor 2 of a heat pump system, not actually shown, by way of a shaft 3. A flywheel 4 is rotatably mounted on the shaft 3 by way of a bearing 5 and is engageable and disengageable from the shaft by means of a clutch 6. The clutch 6 is actuated by a servomotor 9 controlled by a control unit 10. Control unit 10 receives data from a speed sensor 11 that senses the rotational speed of the flywheel 4. If the data is in the form of pulses that occur at a frequency related to the flywheel speed, the control unit may, for example, convert the pulses to an analog signal that it compares to voltage reference levels corresponding to the engagement and disengagement speeds. Based on these comparisons and the engine state, i.e. whether the engine is being started or stopped, the control unit generates logic levels to control the servomotor and hence the clutch.

The flywheel 4 is driven up to speed by a starter that includes a friction gear 7 capable of being driven by a motor 8 and acting on a surface, preferably conical, of the flywheel 4. This gear 7 is engageable and disengageable with the flywheel by axial displacement.

The unit, i.e. the engine 1 and compressor 2, is started when the flywheel 7, which is disengaged from shaft 3 when the unit is at rest, is driven by the motor 8 by way of a friction gear 7 acting on its conical periphery. After reaching a preassigned starting speed, detected by the speed sensor 11, the clutch 6 is engaged by servomotor 9 in response to control unit 10 so that the engine 1 is started by the spinning flywheel 4. After or during engagement of the clutch 6, the friction gear 7 retracts from the friction surface of flywheel 4.

In a departure from the embodiment shown in the drawing, which is merely a schematic representation omitting the details of the design of the clutch and its actuation, the clutch may alternatively be of the type that engages automatically according to the speed, for example a centrifugal clutch.

I claim:

1. A device for starting a stationary unit including a prime mover, e.g. an internal combustion engine, and a machine rigidly coupled thereto, e.g. a compressor of a heat pump system, wherein the device includes a flywheel fitted on a common shaft connecting the prime mover and the machine, which flywheel is engageable and disengageable from the shaft by means of a clutch and is driveable by a starter, characterized in that the clutch is actuated automatically according to the speed of the flywheel.

2. A device according to claim 1, characterized in that the clutch is engageable at a flywheel speed higher than the speed at which the clutch is disengageable.

3. A device as claimed in claim 1 or 2 wherein the clutch is operated by a servomotor in response to signals generated by a speed sensor monitoring the flywheel speed, said speed signals being compared to preassigned values in a control unit so as to control the actuation of said servomotor.

4. A device as claimed in claim 1 wherein the starter is disengageable from said flywheel upon engagement of said clutch.

* * * * *